US006113217A

United States Patent [19]

Araki et al.

[11] Patent Number: 6,113,217

[45] Date of Patent: Sep. 5, 2000

[54] INK-JET PRINTING APPARATUS

[75] Inventors: Yoshimasa Araki, Kawaguchi; Yasuyuki Takanaka, Urawa, both of Japan

[73] Assignee: Canon Kabushiki Kaisha, Tokyo, Japan

[21] Appl. No.: 09/163,399

[22] Filed: Sep. 30, 1998

[30] Foreign Application Priority Data

Oct. 2, 1997 [JP] Japan ..... 9-269992
Sep. 8, 1998 [JP] Japan ..... 10-254408

[51] Int. Cl.[7] ..... B41J 2/14

[52] U.S. Cl. ..... 347/50

[58] Field of Search ..... 347/50, 56, 66, 347/85, 86

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—N. Le
*Assistant Examiner*—Anh T. N. Vo
*Attorney, Agent, or Firm*—Fitzpatrick, Cella, Harper & Scinto

[57] ABSTRACT

An ink-jet printing apparatus can restrict increasing of a cost due to sliding load of a flexible wiring board or an ink supply tube, permit down sizing of the apparatus, and prevent breakage of the flexible wiring board and rapture of the tube. The ink-jet printing apparatus employs a head ejecting ink and performing printing by ejecting ink on a printing medium from the head. The ink-jet printing apparatus includes a flexible wiring board electrically connecting the head and an electric board installed in a main body and having a curve portion, and a displacement restriction member restricting displacement of the flexible wiring board associated with movement of a carriage, the displacement restriction member having a construction with small sliding resistance for the flexible wiring board with respect to a portion contacting with the flexible wiring board.

16 Claims, 16 Drawing Sheets

INK-JET PRINTING APPARATUS

This application is based on Japanese Patent Application No. 269,992/1997 filed Oct. 2, 1997 and Japanese Patent Application No. 254,408/1998, filed Sep. 8, 1998, the contents of which are incorporated hereinto by reference.

BACKGROUND OF THE INVENTION

1. Field of the Invention

The present invention relates generally to an ink-jet printing apparatus electrically connecting a head on a carriage and a printing circuit board in a main body of the apparatus by means of a flexible wiring board. More particularly, the invention relates to an ink-jet printing apparatus for large size printing, in which a motion distance of the carriage is long.

2. Description of the Related Art

As one kind of prior art, an ink-jet printer will be briefly explained with reference to FIGS. 12, 13 and 14.

FIG. 12 is a top plan view of a conventional ink-jet printer, FIG. 13 is a front elevation of the conventional ink-jet printer and FIG. 14 is a section taken along line K—K of FIG. 13. In the ink-jet printer illustrated in these figures, an ink is supplied from an ink tank 8 to a head through a tube 4. The tube 4 has an intermediate curved portion and is connected to a head 1 through a caterpillar 2 which protects and supports the tube.

Namely, the caterpillar 2 is respectively fixed to the main body of the printer and a carriage at both ends and provided with flexibility so as to follow to motion of the carriage 6.

On the other hand, a head 1 and a main board 30 constituting a control board of the printer are electrically connected by a flexible wiring board 3, which is in a form of the flat plate, formed by coating a plurality of conductors with a resin. By this, electrical signals are fed from the main board 30 to the head 1, ejection of the ink by the head can be controlled. The flexible wiring board 3 is loosely supported by a plurality of displacement restricting members 5 mounted on the caterpillar 2. By this, upon shifting the carriage 6 in directions of arrow I shown in FIG. 12, the flexible wiring board 3 can be deformed to curve with a predetermined bending radius together with the caterpillar 2. It should be noted that motion of the carriage 6 is enabled by transmitting a driving force of a carriage motor 10 via a belt 7.

As shown in FIG. 14, a printing paper sheet 13 is fed in a direction shown by arrows G and H in FIG. 14 by a paper feeding roller 17 and a subscanning roller 9. During feeding of the paper sheet, ink is ejected on the printing paper sheet from the head 1 to perform printing.

Next, a construction of the foregoing caterpillar 2 will be explained with reference to FIGS. 15, 16, 17, 18 and 19.

FIG. 15 is a front elevation of the caterpillar 2, in which the tube 4 is received, FIG. 16 is a top plan view of the caterpillar 2 illustrated in a condition where the tube 4 is received, FIG. 17 is a section taken along line L—L of FIG. 15, FIG. 18 is a front elevation showing a component of the caterpillar 2, and FIG. 19 is a top plan view of a component shown in FIG. 18.

The caterpillar 2 is constructed by connecting a plurality of components of substantially U-shaped cross-section shown in FIGS. 18 and 19. Mutual connection of the components becomes possible by rotatably engaging shafts 19 with holes 20 of other components 21. By connecting a plurality of components 21, the caterpillar 2 shown in FIGS. 15 and 16 can be formed. As set forth, the components 21 are pivotable relative to each other about the shafts 19 and the holes 20. Thus, the caterpillar 2 is formed into a polyarticular link structure. As a result, in FIG. 15, when a force in a direction N is exerted at a portion M, a portion O of the caterpillar 2 with a curved portion of the predetermined curve radius is shifted to a portion Q which is shown by a broken line.

Next, a support structure of the flexible wiring board 3 will be explained hereinafter with reference to FIGS. 20, 21 and 22.

FIG. 20 is an enlarged illustration of a portion J of FIG. 13, FIG. 21 is a top plan view of the portion J shown in FIG. 20, and FIG. 22 is a section taken along line M—M of FIG. 20. As shown in FIG. 22, the flexible wiring board 3 is loosely held in a displacement restricting member 5 having a substantially rectangular cross section. The flexible wiring board 3 is inserted into the displacement restricting member 5 by deflecting an engaging leaf spring 16 forming one side of the displacement restricting member 5 to open the displacement restricting member 5. Particularly, when a distance to move the carriage 6 is long, it becomes necessary to support the flexible wiring board 3 so as not to deflect downwardly. Then, the displacement restricting member 5 is engaged by fitting a mounting projection 14 on a side piece of the displacement restricting member mounting member 11 having a substantially U-shaped configuration. On the other hand, the displacement restricting member mounting member 11 is coupled with a caterpillar mounting member 18 mounted on the caterpillar 2 by means of screws 15. With such construction, the flexible wiring board 3 is constructed to be deformed to curve together with the caterpillar 2.

In the conventional ink-jet printer set forth above, since the displacement restricting member 5 is formed of a material having low sliding ability, when the flexible wiring board causes curving deformation associated with movement of the head, a sliding load by the displacement restricting member 5 relative to the flexible wiring board 3 becomes relatively large. In the alternative, when the flexible wiring board 3 is fixed to the displacement restricting member, a reaction force due to flexural rigidity of the flexible wiring board 3 becomes large for not escape margin of the flexible wiring board 3.

On the other hand, since the component of the caterpillar 2 is formed of a material having high frictional property, a sliding resistance with the component of the caterpillar 2 upon curving deformation of the tube associated with movement of the head, becomes large. As a result, 1. A driving load of the carriage becomes large to require large driving force of the carriage driving motor 10 to make a cost of the carriage motor high.
2. With relative sliding motion of the flexible wiring board 3 and the displacement restricting member 5, the flexible wiring board 3 is worn to cause breakage.
3. By slidingly contacting the tube 4 with the caterpillar 3, the tube is worn to cause rapture in the tube 4.

Moreover, in the conventional ink-jet printer, the curve radius of the flexible wiring board 3 is substantially the same as the curve radius of the caterpillar 2. As set forth above, the displacement restricting member 5 is frequently mounted on the side portion along the caterpillar 2. As a result, the displacement restricting member 5 thus mounted hinders down-sizing of the overall apparatus.

Furthermore, in the conventional ink-jet printer, the flexible wiring board 3 is movably constructed with respect to respective of the carriage 6 and the body of the apparatus in the coupling portion between the carriage 6 and the caterpillar 2 and in the coupling portion between the body of the apparatus and the caterpillar 2. As a result, the flexible wiring board 3 may be offset with respect to the carriage 6 or the body of the apparatus to cause a breakage in the flexible wiring board 3.

SUMMARY OF THE INVENTION

Therefore, the present invention has been worked out for solving the foregoing problems. It is an object of the present invention to provide an ink-jet printing apparatus which can restrict increasing of cost due to a sliding load of a flexible wiring board or a tube, permit down-sizing of the apparatus, and prevent breakage of the flexible wiring board and rapture of the tube.

In a first aspect of the present invention, there is provided an ink-jet printing apparatus employing a head ejecting ink and performing printing by ejecting ink on a printing medium from the head, comprising:

a main body;

head mounting means for mounting the head, the head mounting means being reciprocally movable relative to the main body;

a flexible wiring board electrically connecting the head and an electric board installed in the main body and having a curve portion; and a displacement restriction member restricting displacement of the flexible wiring board associated with movement of the head mounting means, the displacement restriction member having a construction with small sliding resistance for the flexible wiring board with respect to a portion contacting with the flexible wiring board.

Here, the construction, in which the sliding resistance is made small, may be formed with a material having high slidability for the contacting portion.

The material having high slidability may be fluorine resin, polyacetal, polyethylene or nylon.

The construction, in which the sliding resistance is made small, may be formed with a part of roller members rotating by contact at a portion contacting with the flexible wiring board.

In a second aspect of the present invention, there is provided an ink-jet printing apparatus employing a head ejecting ink and performing printing by ejecting ink on a printing medium from the head, comprising:

a main body;

head mounting means for mounting the head, the head mounting means being reciprocally movable relative to the main body;

a flexible wiring board electrically connecting the head and an electric board installed in the main body and having a curve portion;

a displacement restriction member restricting displacement of the flexible wiring board associated with movement of the head mounting means, the displacement restriction member having a construction with small sliding resistance for the flexible wiring board with respect to a first portion contacting with the flexible wiring board; and tube supporting means for supporting a tube supplying an ink from an ink tank installed on the main body to the head and having a curve portion, the tube supporting means having a construction with small sliding resistance with respect to at least a second portion contacting with the tube.

Here, the construction, in which the sliding resistance is made small, is formed with a material having high slidability for the first and second contacting portions.

The materials for the first and second contacting portions may be different from each other.

The material having high slidability may be fluorine resin, polyacetal, polyethylene or nylon.

The tube supporting means may be constructed with a caterpillar of a polyarticular link structure connected to the main body at one end and to the head mounting means at the other end thereof, and a plurality of the displacement restricting members may be held by the caterpillar in a curve direction of the caterpillar.

A radius of the curve portion of the flexible wiring board may be smaller than a radius of the curve portion of the tube.

The flexible wiring board may be fixedly supported at a coupling portion between the head mounting means and the tube supporting means and/or at a coupling portion between the main body and the tube supporting means.

An ink-jet printing apparatus may further comprise a depressing member depressing the flexible wiring board to the displacement restricting member, wherein a depressing force by the depressing member being smaller than a supporting force in the vicinity of the coupling portion between the head mounting means and the tube supporting means and in the vicinity of the coupling portion between the main body and the tube supporting means.

The head may generate a bubble in ink using a thermal energy and eject ink by a pressure of the bubble.

The above and the other objects, effects, features and advantages of the present invention will become more apparent from the following description of embodiments thereof taken in conjunction with the accompanying drawings.

DESCRIPTION OF THE PREFERRED EMBODIMENT

Figure 1:
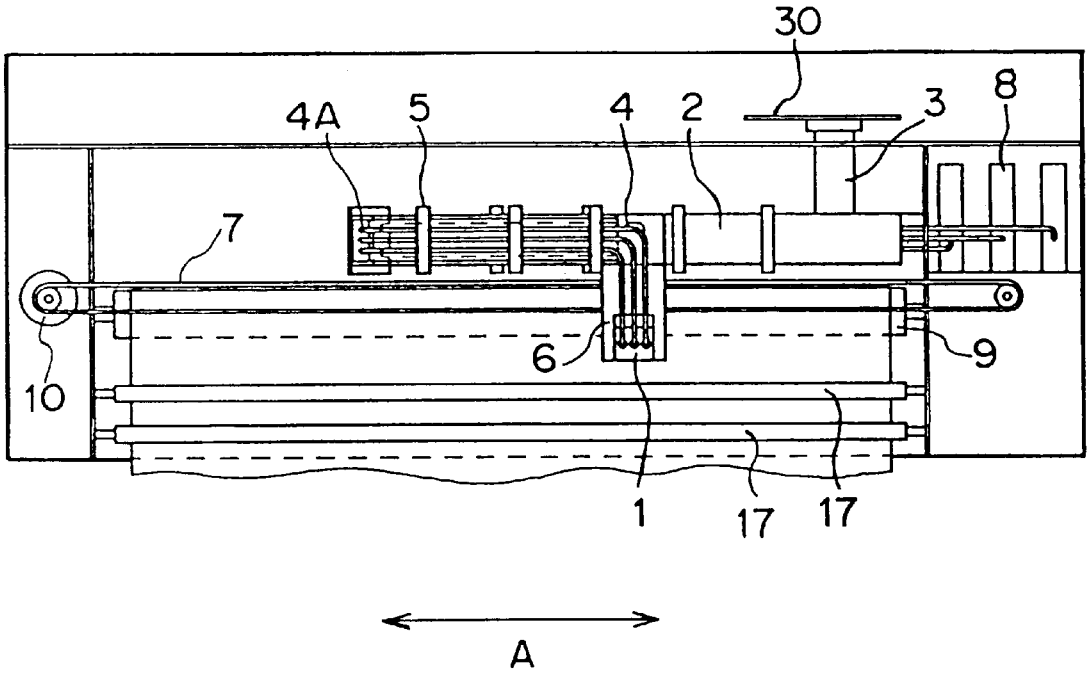
FIG. 1 is a top plan view showing a general construction of the first embodiment of an ink-jet printer according to the present invention.

Modes for implementing the present invention will be explained hereinafter.

(First Embodiment)

In this embodiment, nylon, for example, is selected as a resin of the flat flexible wiring board 3 formed by coating a plurality of conductors with the resin. On the other hand, a material having high sliding ability or low friction, such as a material selected among a group of fluorine contained resin, polyacetal, polyethylene, nylon and the like, and different from the material of the resin of the flexible wiring board 3, is used for forming the displacement restriction member for the flexible wiring board. Thus, sliding load to be exerted on the flexible wiring board from the displacement restriction member can be reduced.

On the other hand, by arranging the flexible wiring board within a curving plane of a tube supporting member, the flexible wiring board and the displacement restriction member is received within a portion being a dead space in the conventional device, the overall apparatus can be formed in compact.

(Second Embodiment)

In this embodiment, a tube supplying an ink from an ink tank installed on a main body of the printer to a head and having a curved portion, is formed of vinyl chloride, for example. For at least a portion of a caterpillar, as a tube supporting means, formed of polycarbonate, for example, a material having high slidability or low friction, such as a material selected among a group consisted of fluorine contained resin, polyacetal, polyethylene, nylon and the like, is used. Thus, the material different from the material of the tube is used so that sliding load of the tube received from the caterpillar can be reduced.

(Third Embodiment)

In this embodiment, the displacement restriction member mounted on the tube supporting member supports the flexible wiring board via roller members rotatably supported, the flexible wiring board can be moved with respect to the displacement restriction member at low load.

(Fourth Embodiment)

In this embodiment, at a coupling portion between a carriage and the tube supporting member and at a coupling portion between the main body of the printer and the tube supporting member, the flexible wiring board is fixed to the displacement restriction member by a fixing member. Thus, offsetting of the flexible wiring board with respect to the carriage and the main body of the printer can be prevented.

(Fifth Embodiment)

In this embodiment, at the curve portion of the flexible wiring board, a depression force upon depressing the flexible wiring board by the displacement restriction member or the roller members can be made smaller than a supporting force of the displacement restriction member and the roller members supporting the flexible wiring board in the vicinity of the coupling portion between the carriage and the tube supporting member and in the vicinity of the coupling portion between the main body of the printer and the tube supporting member. By this, in the curve portion of the flexible wiring board, the flexible wiring board can be slide with respect to the displacement restriction member at low load. Also, in the vicinity of the coupling portion between the carriage and the tube supporting member and in the vicinity of the coupling portion between the main body of the printer and the tube supporting member, offsetting of the flexible wiring board with respect to the carriage and the main body of the printer can be prevented.

Hereinafter, preferred embodiments of an ink-jet printing apparatus according to the present invention will be explained with reference to the drawings.

(Embodiment 1)

At first, the first embodiment of an ink-jet printer according to the present invention will be explained briefly with reference to FIGS. 1, 2, 3 and 30.

Figure 2:
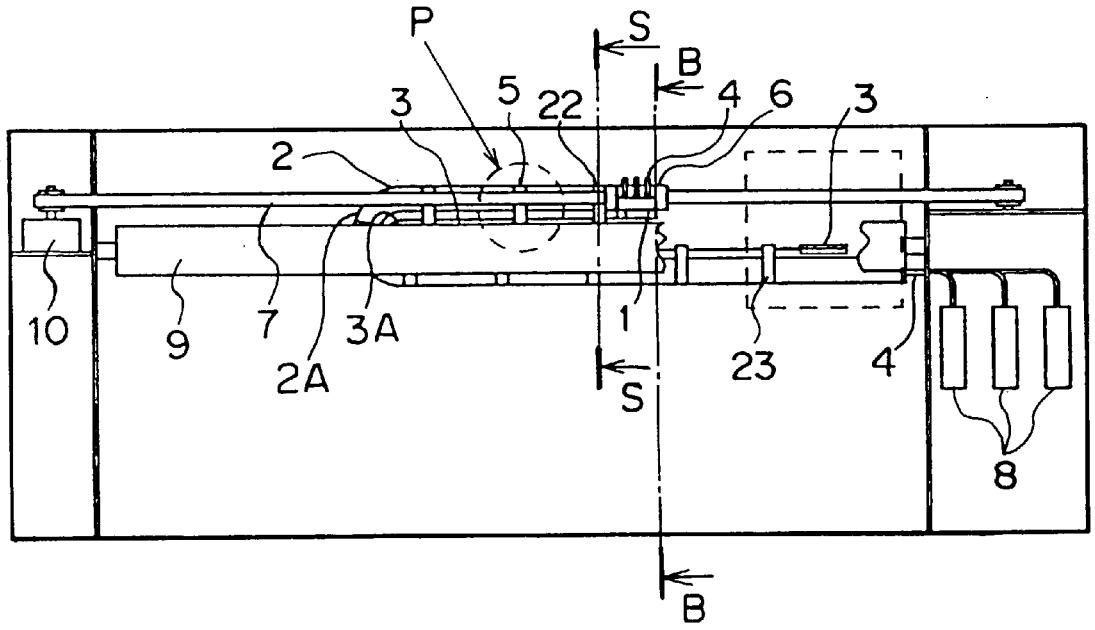
FIG. 2 is a front elevation of the first embodiment of the ink-jet printer.
Figure 3:
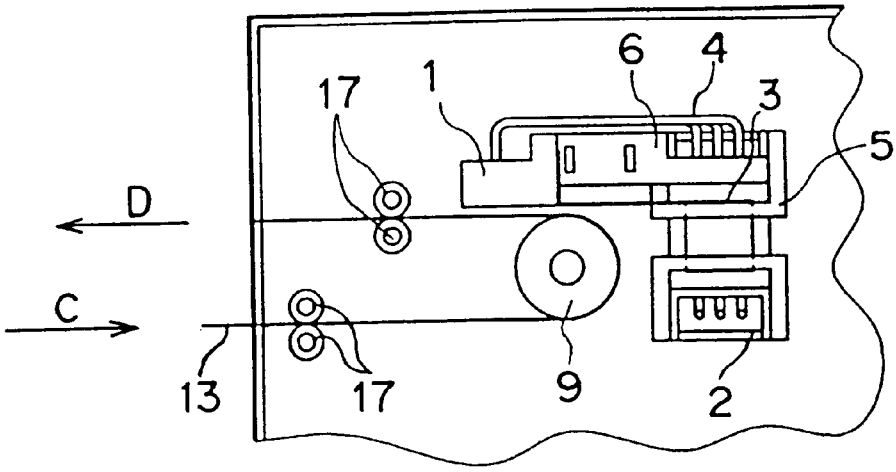
FIG. 3 is a section taken along line B—B of FIG. 2.
Figure 12:
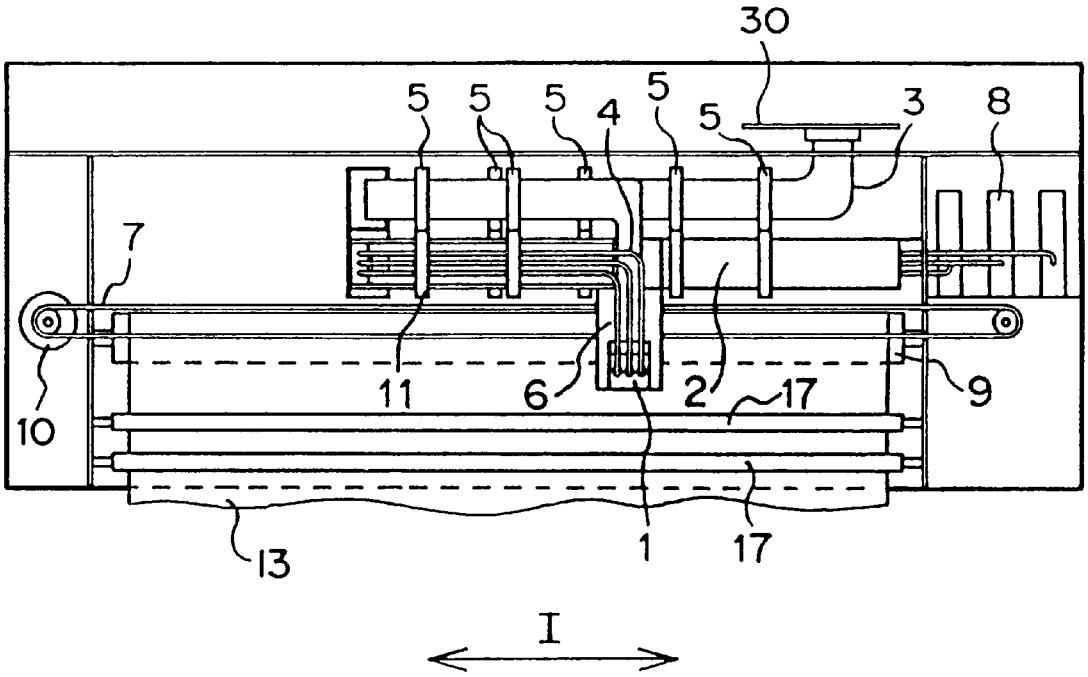
FIG. 12 PRIOR ART
FIG. 12 is a top plan view generally showing the conventional ink-jet printer.
Figure 13:
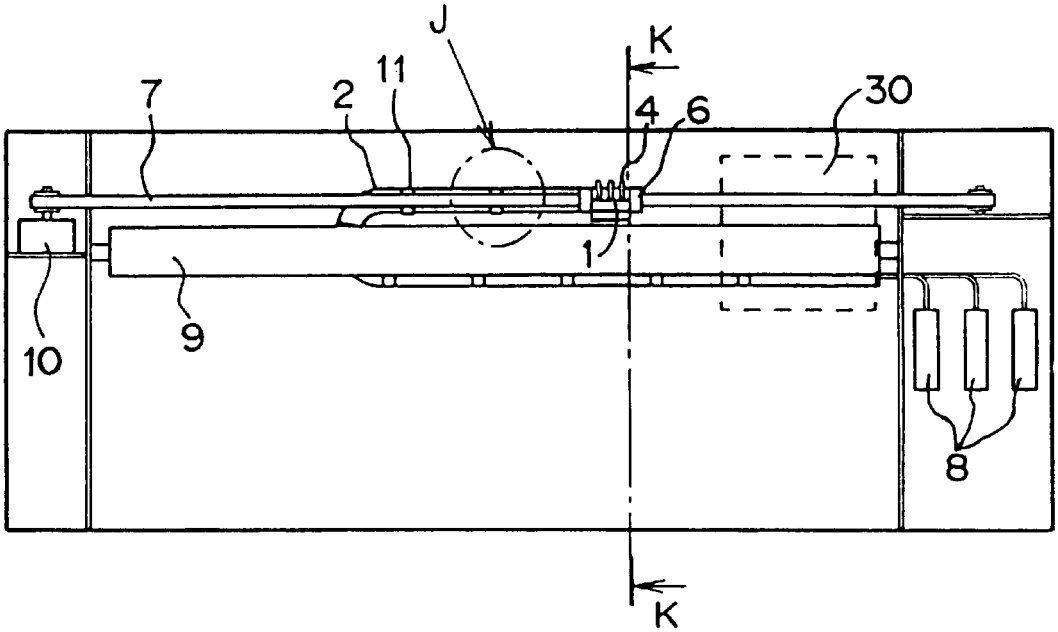
FIG. 13 PRIOR ART
FIG. 13 is a front elevation showing general construction of the conventional ink-jet printer.
Figure 14:
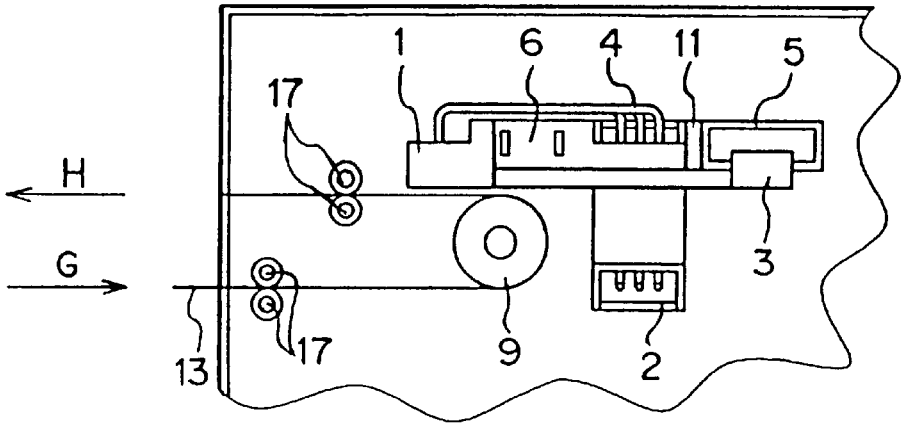
FIG. 14 PRIOR ART
FIG. 14 is a section taken along line K—K of FIG. 13.
Figure 15:
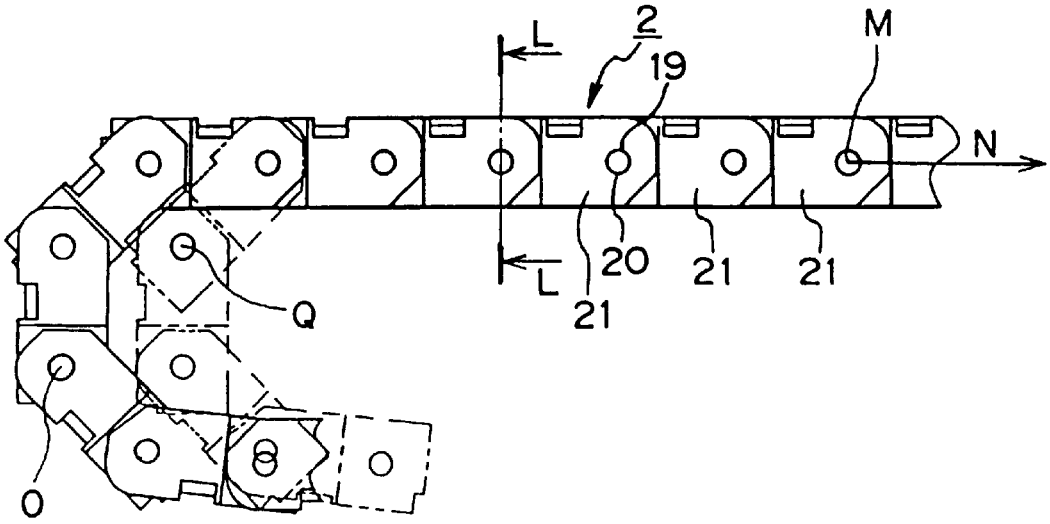
FIG. 15 PRIOR ART
FIG. 15 is a front elevation of a caterpillar.
Figure 16:
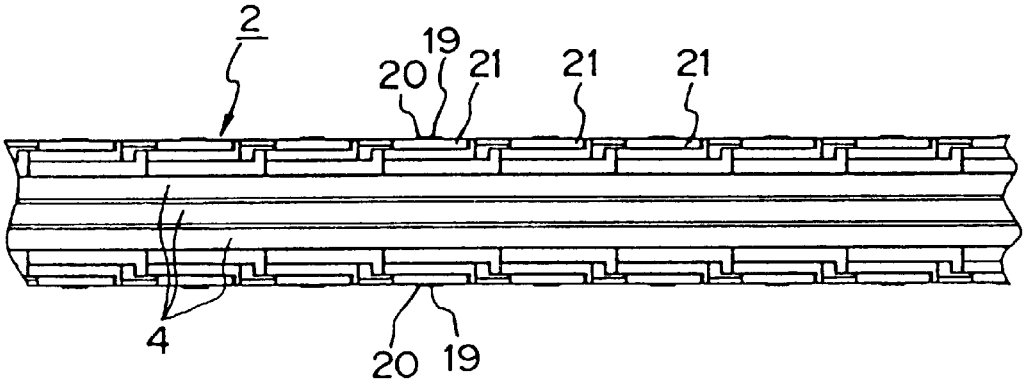
FIG. 16 PRIOR ART
FIG. 16 is a top plan view of the caterpillar.
Figure 17:
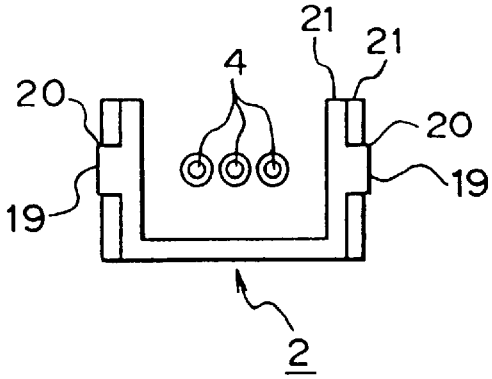
FIG. 17 PRIOR ART
FIG. 17 is a section taken along line L—L of FIG. 15.
Figure 18:
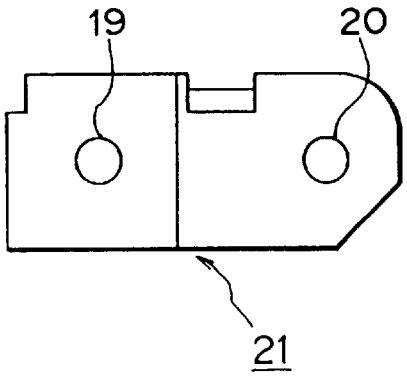
FIG. 18 PRIOR ART
FIG. 18 is a front elevation of the member forming the caterpillar.
Figure 19:
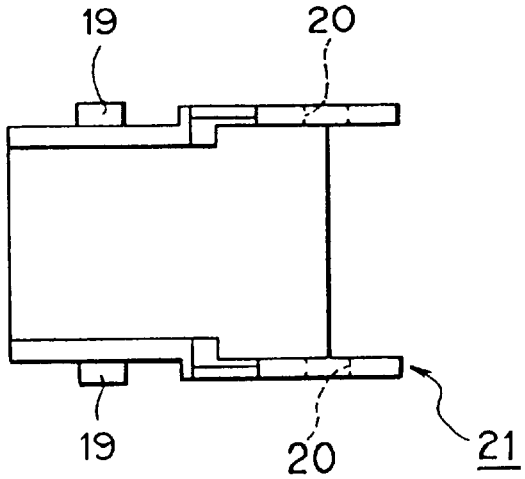
FIG. 19 PRIOR ART
FIG. 19 is a top plan view of the component.
Figure 20:
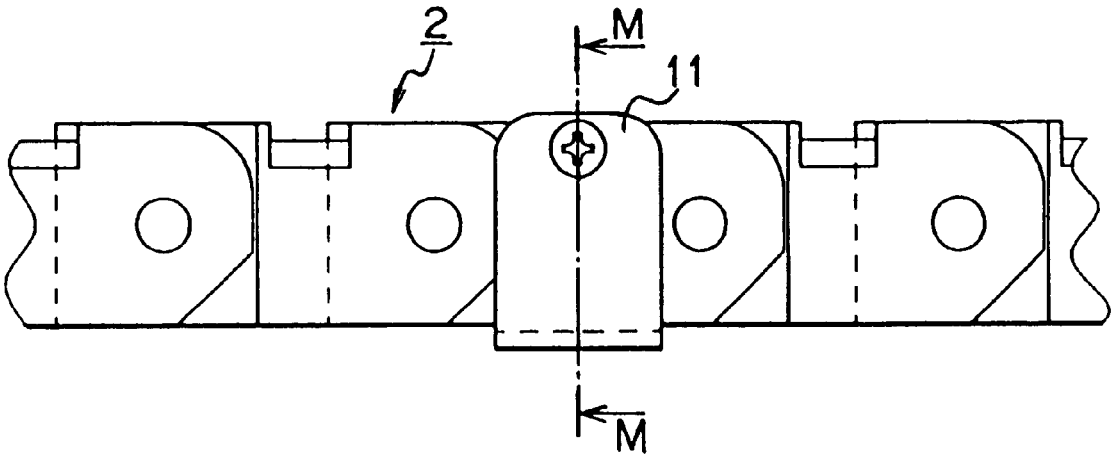
FIG. 20 PRIOR ART
FIG. 20 is an enlarged illustration of a portion J of FIG. 13.
Figure 21:
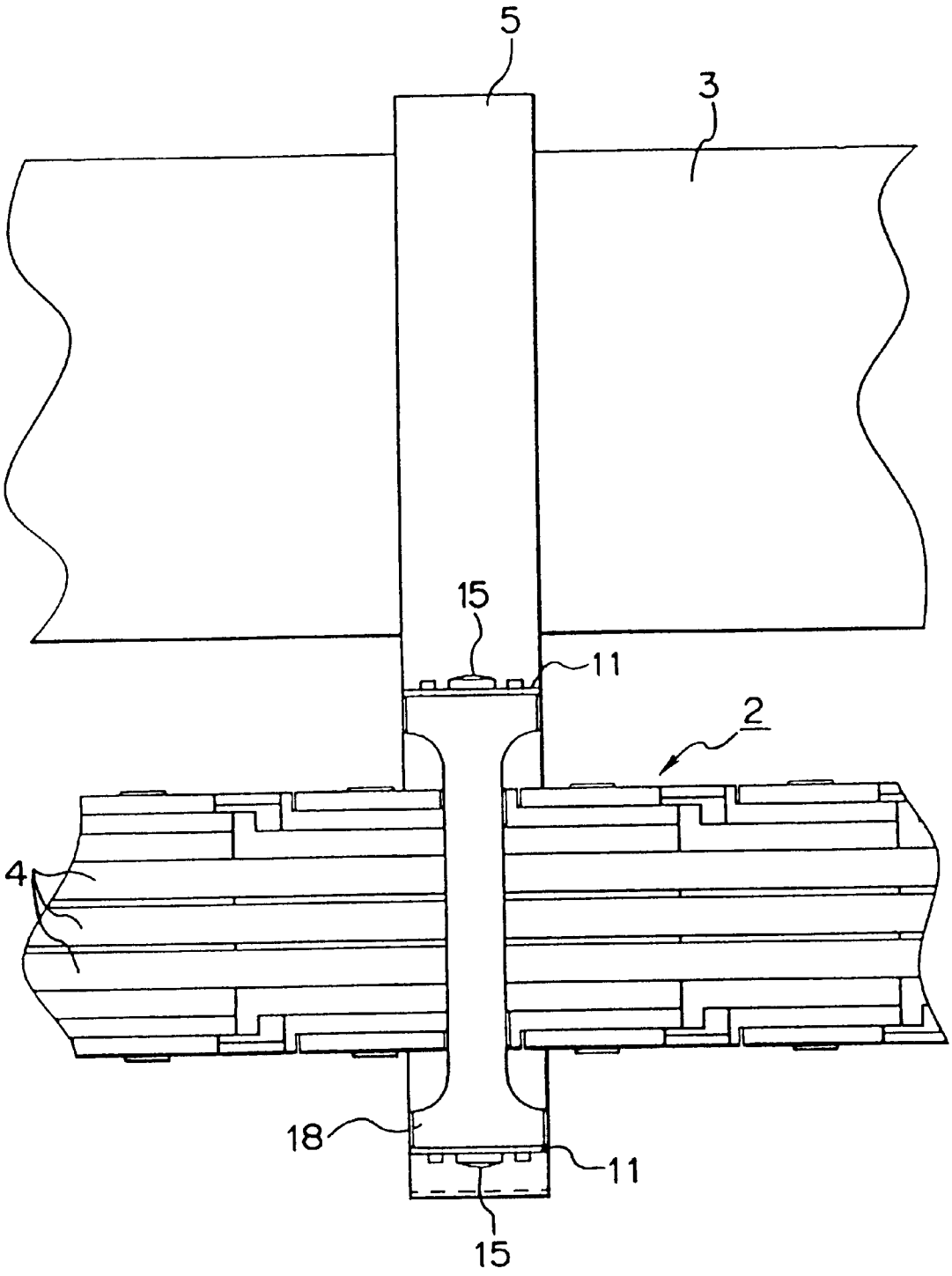
FIG. 21 PRIOR ART
FIG. 21 is an enlarged illustration of the portion J of FIG. 20.
Figure 30:
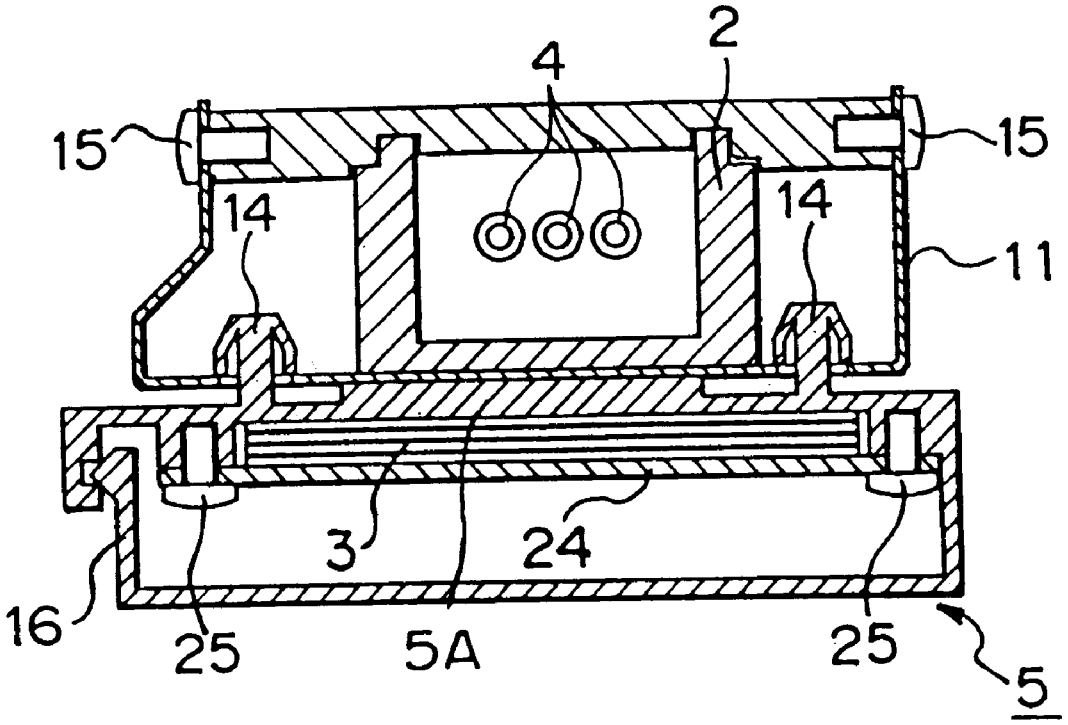
FIG. 30 is a section taken along line S—S of FIG. 2.

FIG. 1 is a top plan view of the ink-jet printer, FIG. 2 is a front elevation of the ink-jet printer and FIG. 3 is a section taken along line B—B of FIG. 2. On the other hand, FIG. 30 is a section taken along line S—S of FIG. 2 at a coupling portion 22 between a carriage 6 and a caterpillar 2. In these figures, like elements to those shown in FIGS. 12, 13 and 14 set forth above will be identified by like reference numerals to neglect explanation therefor in order to keep the disclosure simple enough by avoiding redundant disclosure for facilitating clear understanding of the invention.

As shown in FIGS. 1, 2 and 30, the flexible wiring board 3 is fixed by mounting a holding member 24 which depresses the flat plate form flexible wiring board 3 onto one edge 5A of the displacement restricting member 5 of generally rectangular cross-sectional shape on the side of caterpillar 2, onto the displacement restriction member 5, at the coupling portion 22 between the carriage 6 and one end of the caterpillar 2 and a coupling portion 23 between the main body of the printer and the other end of the caterpillar 2. (It should be noted that at the coupling portion 23 between the main body of the printer and the caterpillar 2, up and down relationship shown in FIG. 30 is reversed.)

The tube 4 each is supported on the man body of the apparatus at one end portion thereof in the vicinity of the ink tank 8 installed on the main body of the printer, and on the carriage 6 at the other end portion thereof. Also, an intermediate portion of the tube 4 is received in the caterpillar 2.

Thus, the tube 4 extending in the substantially horizontal direction droopes downwardly due to influence of gravity. By contacting an upper portion of a curve portion 4A of the tube 4 onto an upper portion of a curve portion of the caterpillar 2, the tube 4 is supported on the caterpillar 2 in a manner capable of curing deformation. The tube 4 is generally formed of vinyl chloride or the like.

It should be noted that a structure of the caterpillar 2 is the same as that of the prior art and explanation therefor will be neglected. It should be noted that a component 21 forming the curve portion of the caterpillar 2 contacting with the intermediate portion of the tube is preferably formed of a material having high slidability, such as fluorine resin, polyacetal, polyethylene, nylon and the like. It is also possible to attach to or apply a material having high slidability on an inner wall defining a space receiving the tubes 4, while not illustrated, instead of forming the overall component 21 with the material having high slidability.

Next, a supporting structure of the flexible wiring board 3 will be described hereinafter with reference to FIGS. 4, 5 and 6.

Figure 4:
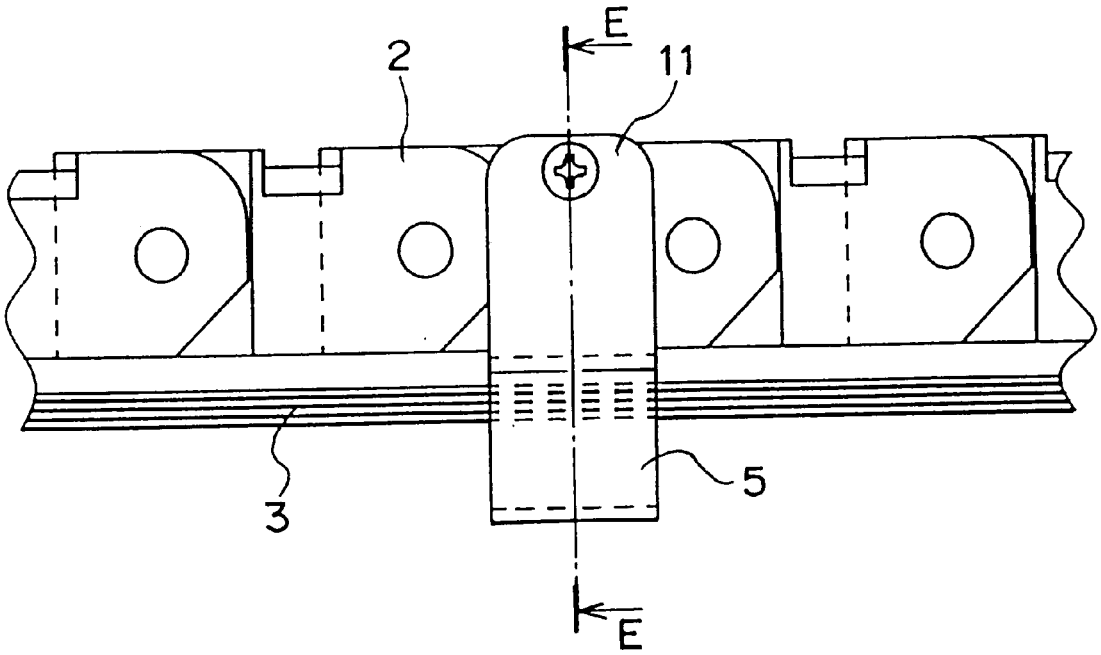
FIG. 4 is an enlarged illustration of a portion P shown in FIG. 2.
Figure 5:
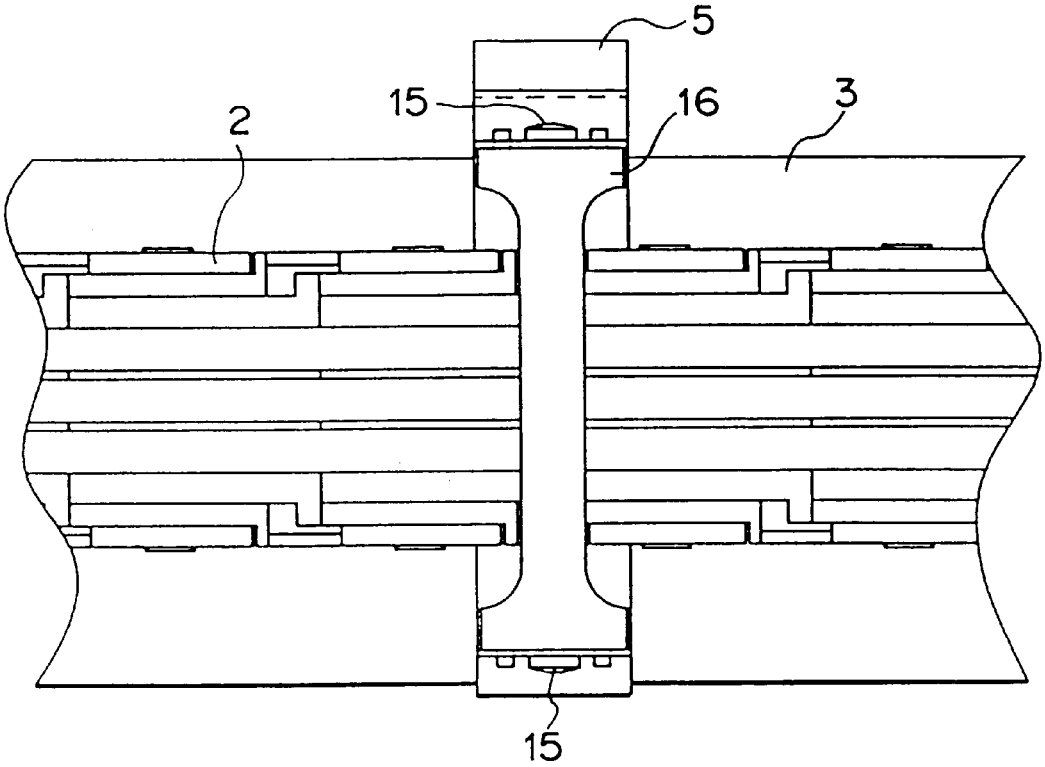
FIG. 5 is a top plan view of the portion P shown in FIG. 4.
Figure 6:
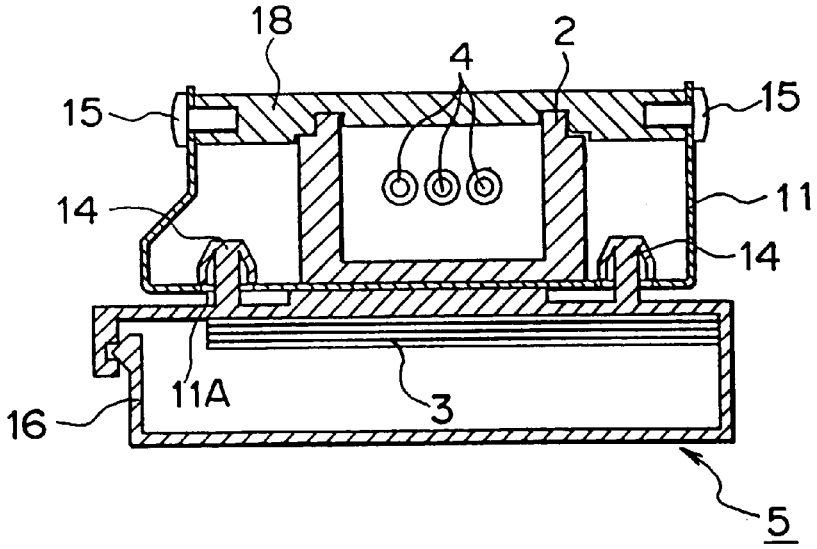
FIG. 6 is a section taken along line E—E of FIG. 4.

FIG. 4 is an enlarged illustration of a portion P shown in FIG. 2, FIG. 5 is a top plan view of the portion P shown in FIG. 2 and FIG. 6 is a section taken along line E—E of FIG. 4.

As shown in FIG. 6, the flexible wiring board 3 is inserted into the displacement restricting member 5 by deflecting an engaging leaf spring portion 16 forming one side of the displacement restricting member 5 having a substantially rectangular section to permit penetration of the flexible wiring board 3. By this, the flexible wiring board 3 is loosely supported in a movable fashion within the displacement restriction member 5. The displacement restriction member 5 is coupled with a displacement restriction member mounting member 11 by engaging two mounting projections 14 integrally formed with the displacement restriction member 5 with mounting holes 11A of the displacement restriction member mounting member 11, on the lower side of the displacement restriction member mounting member 11. On the other hand, the displacement restriction member mounting member 11 is mounted on a caterpillar mounting member 18 bridged over an opening end portion of the component 21 by means of screws 15 and thus is coupled with the caterpillar 2.

By this, the flexible wiring board 3 is constructed for causing curving deformation together with the caterpillar 2.

Here, the displacement restriction member 5 is formed of a material having high slidability with respect to the flexible wiring board 3, such as fluorine resin, polyacetal, polyethylene, nylon or the like. When the flexible wiring board 3 is formed of nylon, it is most preferred to form the displacement restriction member 5 of polyacetal.

The displacement restriction members 5 are mounted on the caterpillar 2 at a predetermined pitch via the caterpillar mounting member 18. A mounting position of the displacement restriction member 5 to the caterpillar 2 is different from that in the prior art and is selected so that the flexible wiring board 3 is located in the curving plane of the caterpillar 2. By this, the flexible wiring board 3 forms a different curve radius than the curve radius of the caterpillar. Namely, as shown in FIG. 6, the displacement restricting member 5 is different from that in the prior art (FIG. 22), and is mounted on the lower side of the caterpillar 2, so that the curve radius of the flexible wiring board 3 becomes smaller than the curve radius of the caterpillar 2. As a result, a space inside the caterpillar 2 (on the side to which the caterpillar 2 curves) which has been a dead space in the prior art, can be effectively used to make the overall apparatus compact.

In the ink-jet printer constructed as set forth above, by a control signal fed from a not shown control unit, the carriage motor 10 is driven. The driving force of the carriage motor 10 is transmitted to the carriage 6 via the belt 7 to reciprocally drive the carriage 6. According to reciprocal motion of the carriage 6, the curve portions 2A, 3A and 4A of respective caterpillar 2, the flexible wiring board 3 and the tube 4 move following to the carriage 6. Then, displacement of the flexible wiring board 3 caused by movement of the curve portion 3A of the flexible wiring board 3 is restricted by the displacement restricting member 5. Even when the flexible wiring board 3 becomes in contact with the displacement restricting member 5, the material of the displacement restricting member 5 is formed of a material of high slidability to make the sliding load small. On the other hand, even when the tube 4 comes into contact with the caterpillar 2 associating with movement of the curve portion 4A of the tube 4, the component 21 forming the curve portion 2A of the caterpillar 2 is formed of a material having high slidability to similarly make the sliding load small.

Figure 7:
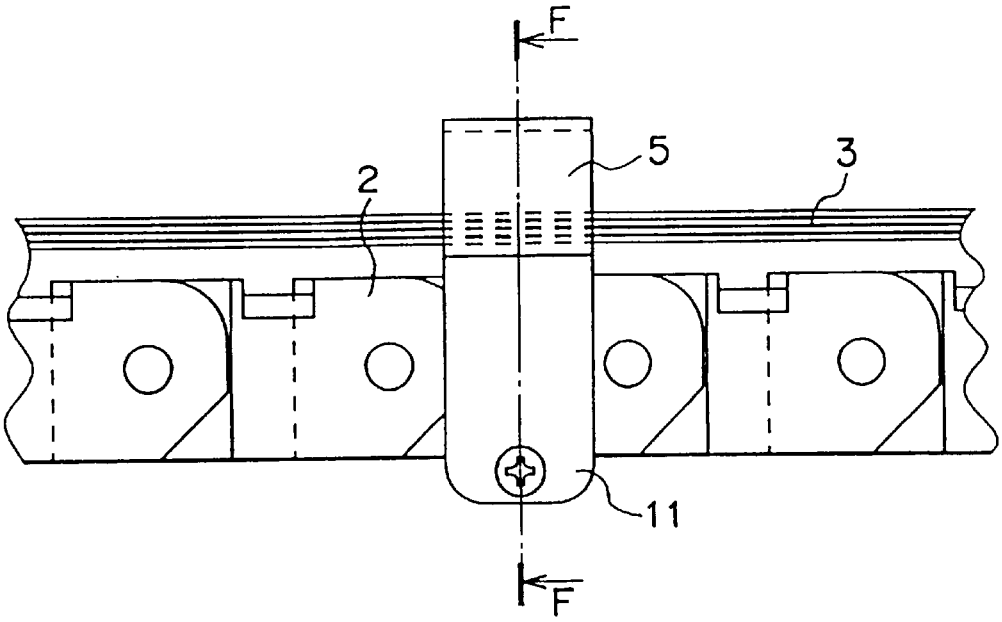
FIG. 7 is an enlarged illustration of a portion corresponding to the portion P of FIG. 2 in the case where a part of arrangement is modified.
Figure 8:
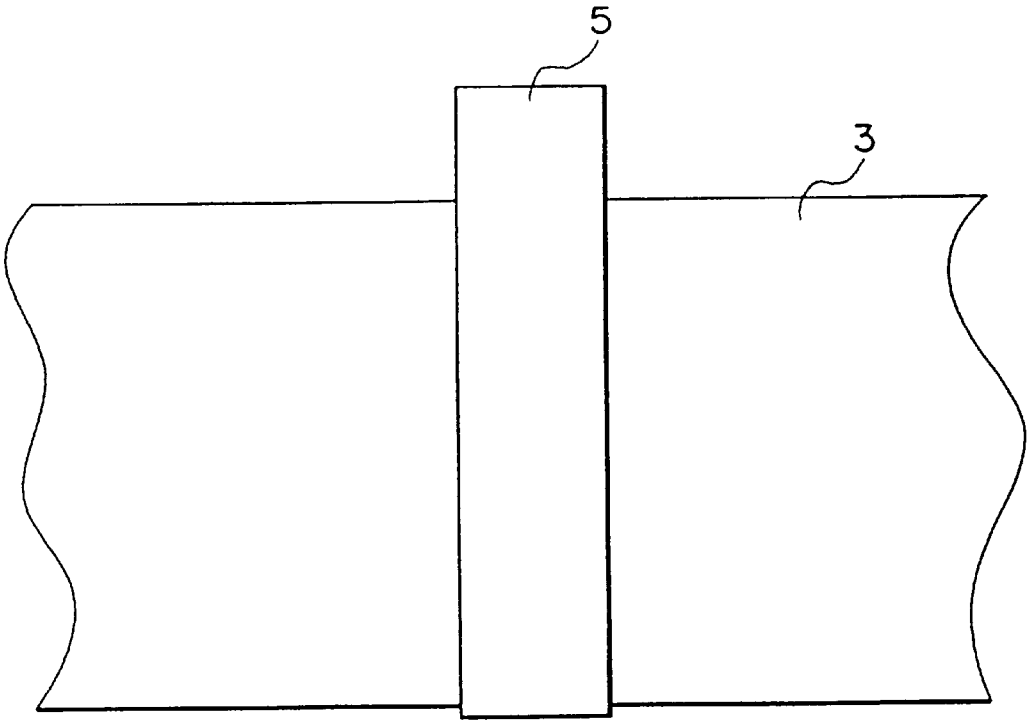
FIG. 8 is a top plan view of the portion shown in FIG. 7.
Figure 9:
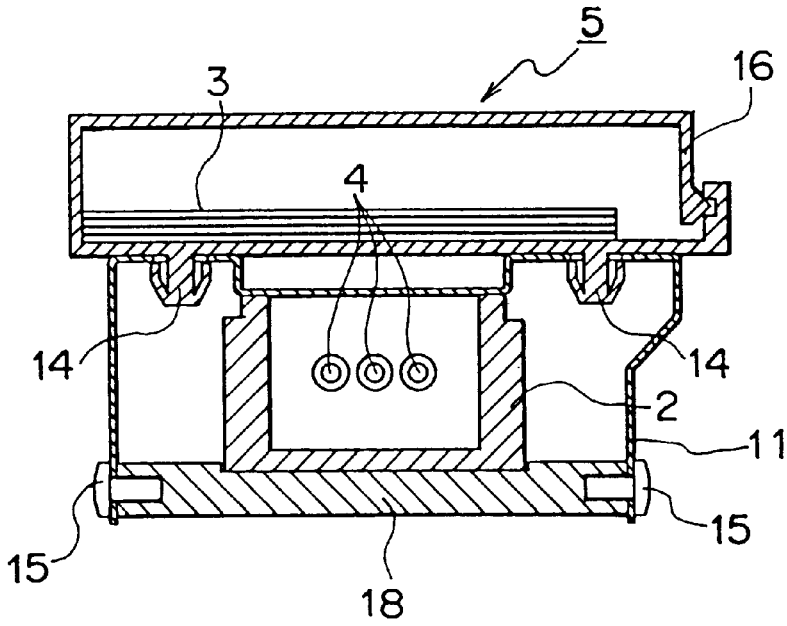
FIG. 9 is a section taken along line F—F of FIG. 7.

A modification for the case where constraint in design is present due to a problem of wiring on the flexible wiring board 3, and other reason, is illustrated in FIGS. 7, 8 and 9. FIG. 7 is an enlarged illustration of a portion corresponding to the portion P of FIG. 2 in the case where a part of arrangement is modified, FIG. 8 is a top plan view of the portion shown in FIG. 7, and FIG. 9 is a section taken along line F—F of FIG. 7. In the shown modification, the flexible wiring board 3 is arranged on the outside of the caterpillar 2. Namely, the flexible wiring board 3 is arranged so that the curve radius of the flexible wiring board 3 becomes greater than the curve radius of the caterpillar 2. In this case, while the space inside of the caterpillar 2 is not effectively used, in comparison with the construction for arranging the flexible wiring board 3 of the prior art (FIG. 22) in parallel with the caterpillar 2, it becomes effective for down-sizing of the apparatus.

Figure 22:
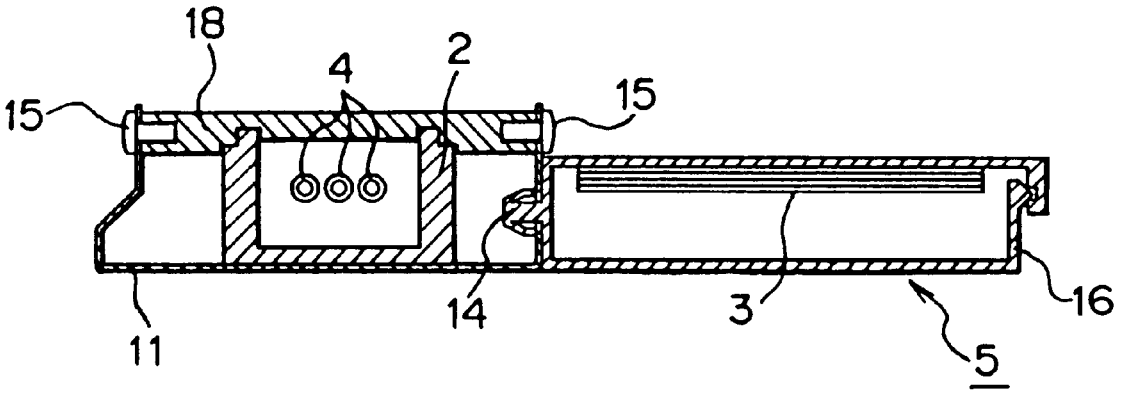
FIG.22 PRIOR ART
FIG. 22 is a section taken along line M—M of FIG. 20.
Figure 23:
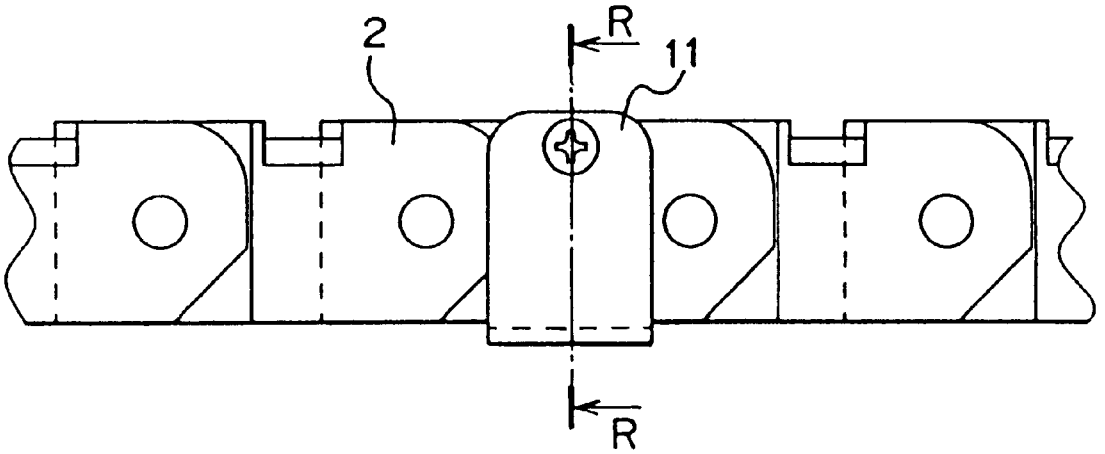
FIG. 23 is an enlarged illustration of the portion P shown in FIG. 2, in connection with another embodiment.
Figure 24:
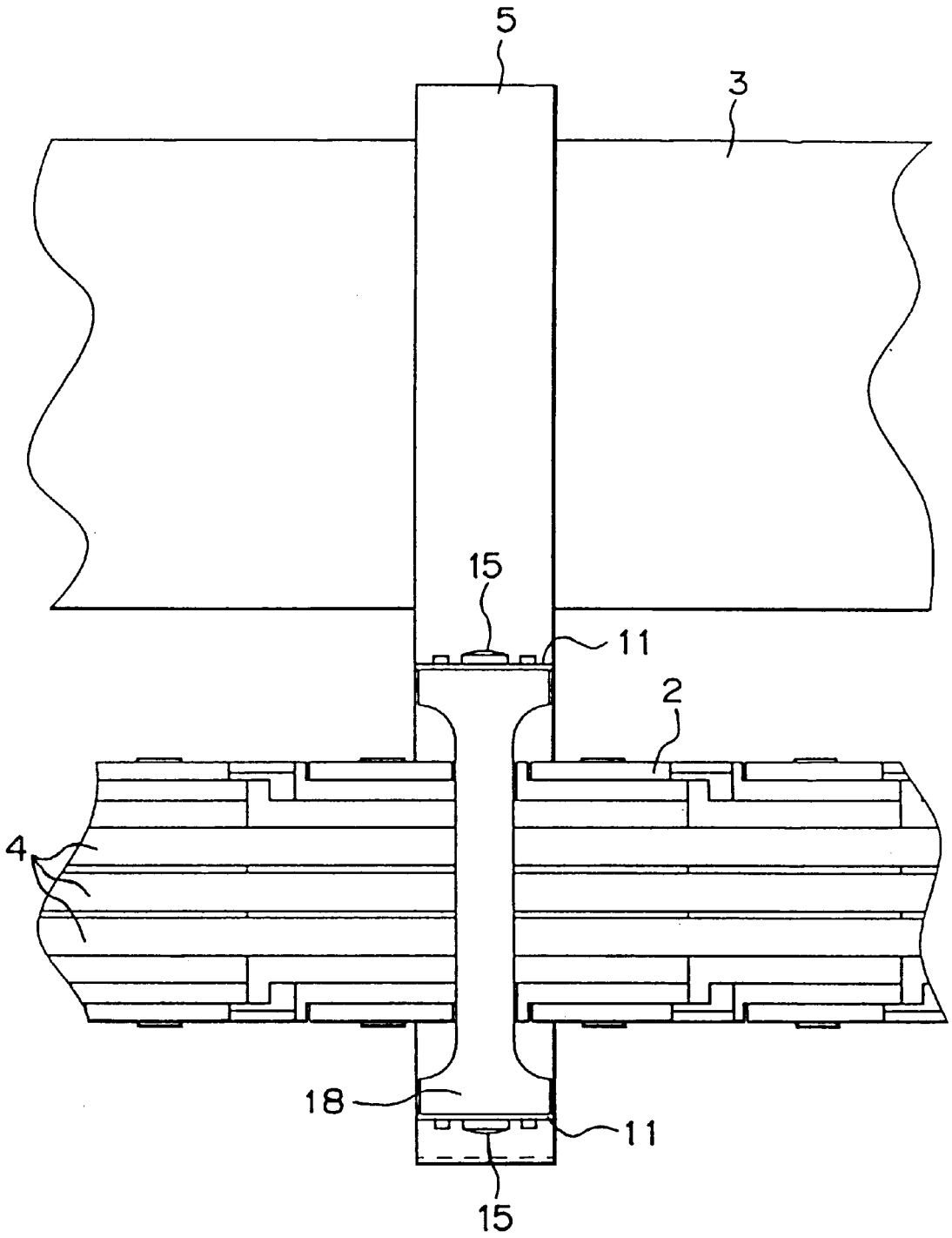
FIG. 24 is a top plan view of the portion shown in FIG. 23.
Figure 25:
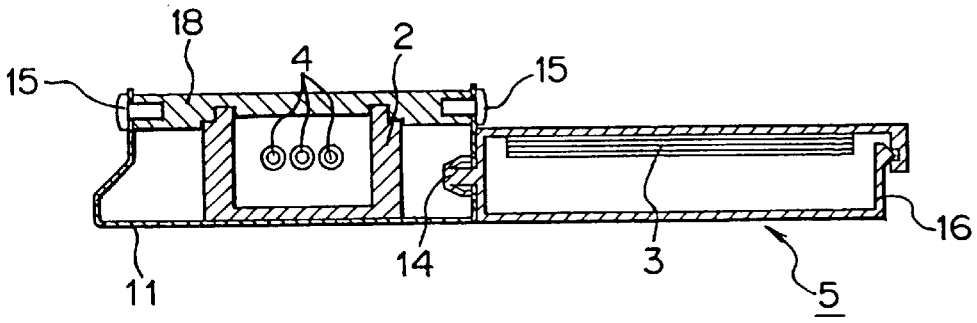
FIG. 25 is a section taken along line R—R of FIG. 23.

On the other hand, as shown in FIGS. 23, 24 and 25, even with the same arrangement as that of the prior art shown in FIG. 22 and so on, by using the material of high slidability for the displacement restriction member as set forth above, sliding load of the flexible wiring board 3 can be lowered.

Furthermore, a plurality of the flexible wiring boards 3 may be stacked as required. In this case, it is desirable that the flexible wiring board 3 having coated surfaces with the material having high slidability is used. On the other hand, it is not extremely necessary to form the overall displacement restriction member 5 of the material having high slidability, but is possible to form only a portion of the displacement restricting member 5 to contact with the flexible wiring board 3.

It should be noted that since the caterpillar 2 is provided with the displacement restriction members spaced away from each other at a predetermined pitch, there are portions to contact with the flexible wiring board 3. By using members of the slidable material in these portions, it is apparent that the present invention can be more effectively implemented.

(Embodiment 2)

Figure 10:
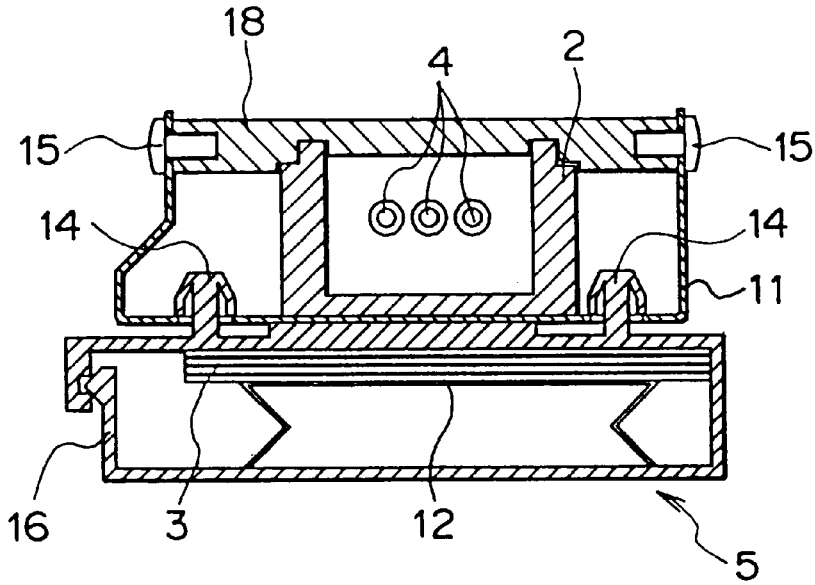
FIG. 10 is a section taken along line E—E in a portion similar to the portion shown in FIG. 4, in the second embodiment of the ink-jet printer according to the present invention.

FIG. 10 is a section of embodiment 2 of the ink-jet printer according to the present invention.

This embodiment, in addition to the structure of Embodiment 1, is provided with a flexible wiring board support 12 formed of a material having high slidability on the displacement restricting member 5 integrally or separately in order to certainly restrict a position of the flexible wiring board 3. Since the position of the flexible wiring board 3 is certainly restricted by the flexible wiring board support 12, breakage of the flexible wiring board 2 within the displacement restricting member 5 due to twisting or so on can be successfully prevented. It should be noted that it is desirable that the flexible wiring board support 12 has a proper elasticity. Other construction is the same as embodiment 1 and explanation for the common portions will be omitted.

(Embodiment 3)

Figure 11:
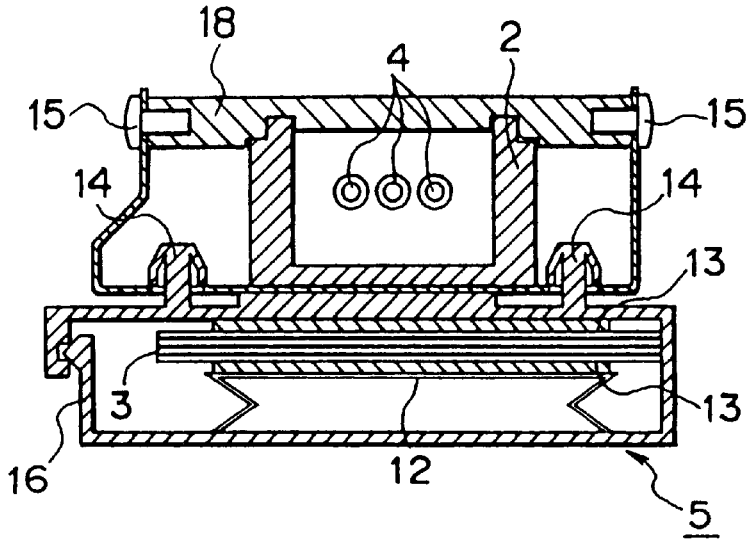
FIG. 11 is a section taken along line E—E in a portion similar to the portion shown in FIG. 4, in the third embodiment of the ink-jet printer according to the present invention.

FIG. 11 is a section of embodiment 3 of the ink-jet printer in accordance with the present invention.

In embodiment 3, in addition to embodiment 2 set forth above, holding members 13 are respectively mounted on both of the flexible wiring board support 12 and the displacement restriction member 5. In this case, by forming the holding member 13 of a material having high slidability, the displacement restriction member 5 is not necessarily a slidable member. The holding member 13 is formed of a fluorine tape, felt and so forth to serve for restricting the position of the flexible wiring board 3 without damaging the flexible wiring board 3. Other construction is the same as embodiment 1 and explanation for the common portions will be omitted.

(Embodiment 4)

FIGS. 26, 27, 28 and 29 are sections showing four examples of constructions in embodiment 4 of the present invention.

In the shown embodiment, in place of the member having high slidability in the displacement restriction member 5, rollers 26 are provided then, the flexible wiring member 5 is supported by the rollers 26.

Figure 26:
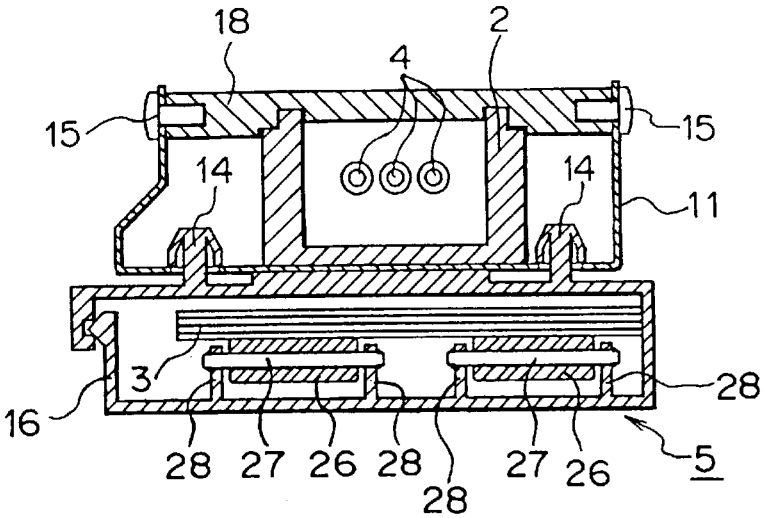
FIG. 26 is a section of the portion corresponding to a portion taken along line E—E of FIG. 4, in terms of a further embodiment.

In the example shown in FIG. 26, the roller 26 is rotatably supported on a roller shaft 27. The roller shaft 27 is supported by a roller supporting portion 28 provided on the displacement restriction member 5. The roller 26 can be provided on the surface where the flexible wiring board 3 contacts with the displacement restriction member 5 by its own bending rigidity.

Figure 27:
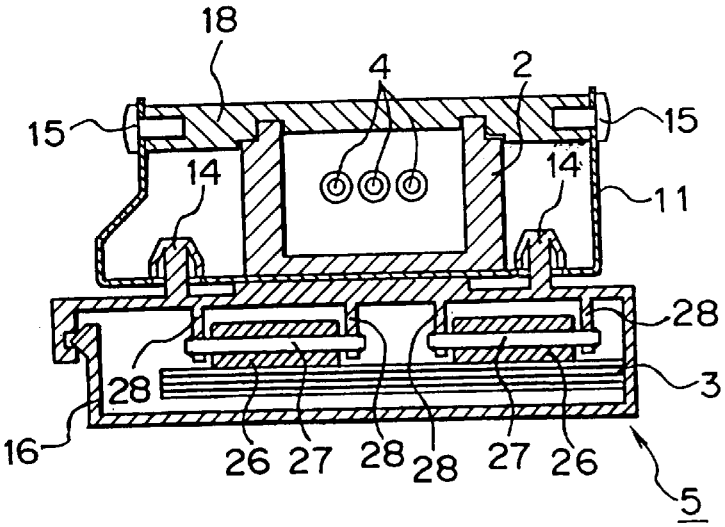
FIG. 27 is a section of a portion corresponding to a portion taken along line E—E of FIG. 4 in terms of a still further embodiment.
Figure 28:
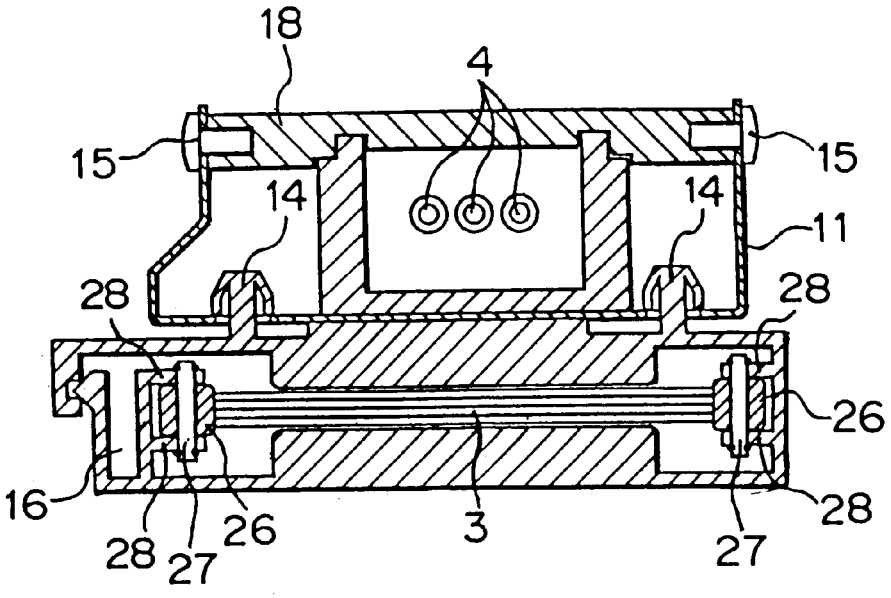
FIG. 28 is a section of the portion corresponding to a portion taken along line E—E of FIG. 4 in terms of a yet further embodiment.
Figure 29:
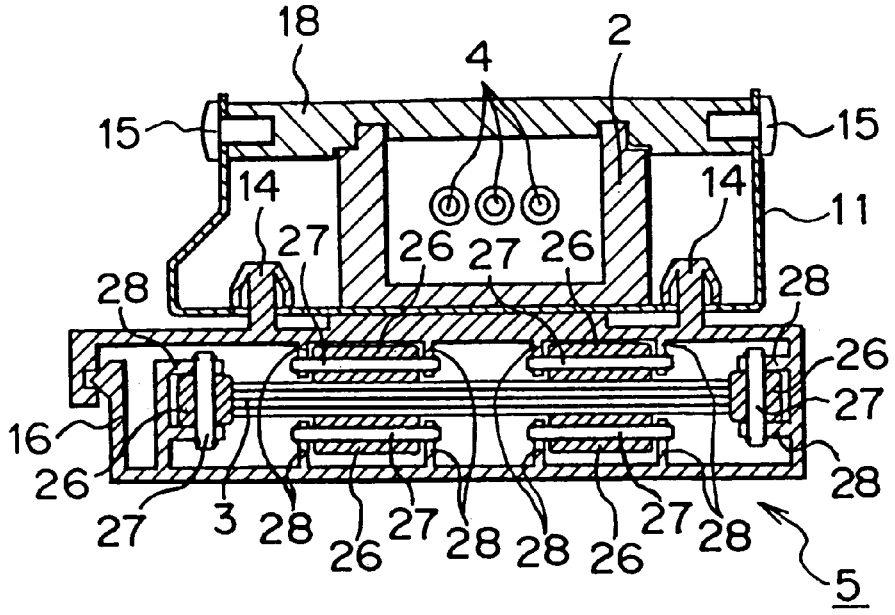
FIG. 29 is a section of the portion corresponding to a portion taken along line E—E of FIG. 4 in terms of a still further embodiment.

The rollers 26 may be arranged on the upper side of the flexible wiring board 3 within the displacement restriction member 5 of generally rectangular cross-section, as shown in FIG. 27. Alternatively, as shown in FIG. 28, the rollers 26 may be arranged on left and right sides of the flexible wiring board 3. In the further alternative, as shown in FIG. 29, the rollers 26 may be arranged upper and lower sides and left and right sides of the flexible wiring board 3. In order to further reduce the sliding load between the flexible wiring board 3 and the displacement restriction member 5, the flexible wiring member may use highly slidable material, such as fluorine resin, polyacetal, polyethylene, nylon and so forth at any portions contacting with the displacement restricting member 5. By constructing as set forth above, the flexible wiring board 3 can be moved with respect to the displacement restriction member with small load.

On the other hand, in the construction shown in FIGS. 26, 27 and 28, by mounting the holding member 13 explained in embodiment 3 on the displacement restricting member 5, sliding load between the flexible wiring board 3 and the displacement restricting member 5 can be further reduced. The holding member 13 may be formed of the fluorine tape and the felt, as set forth above.

On the other hand, in the coupling portion between the carriage 6 and the caterpillar 2, and in the coupling portion between the main body of the printer and the caterpillar 2 shown in FIG. 2, a force to be exerted for depressing the flexible wiring board 3 by the rollers 26 may be greater than a depression force to be exerted on the flexible wiring board 3 by the rollers 26 in other mounting portion of the displacement restriction member 5. By constructing as set forth above, the flexible wiring board 3 may not offset with respect to the carriage 6 and the main body of the printer. Thus, occurrence of breakage of the flexible wiring board 3 due to offset thereof relative to the main body of the printer and the carriage 6, can be successfully avoided.

It should be noted that other construction is the same as embodiment 1 and explanation for the common portions will be omitted.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to ondemand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As set forth above, according to the present invention, by reducing sliding resistance between the flexible wiring board and the displacement restricting member and/or by reducing sliding resistance between the tube and the tube supporting means, the driving load of the carriage can be reduced to reduce driving force of the carriage driving motor. Thus, cost for the carriage driving motor can be reduced. Also, it becomes possible to prevent occurrence of wearing and breaking of the flexible wiring board and/or rapture of the tube, can be successfully prevented.

On the other hand, according to the present invention, by supporting the flexible wiring board in the ink-jet printer with rollers rotatably supported on the flexible wiring board supporting member, the flexible wiring board can be moved with respect to the flexible wiring board support member at low load. Thus, driving load of the carriage can be reduced to reduce driving force of the carriage driving motor. Therefore, cost for the carriage driving motor can be reduced. On the other hand, it becomes possible to prevent the flexible wiring board from wearing and breakage.

Furthermore, in the present invention, in the ink-jet printer, by arranging the flexible wiring board in the bending direction of the tube supporting member, the portion which has been the dead space conventionally, can receive the flexible wiring board and the displacement restriction member to permit the overall apparatus to be made compact.

In addition, by fixedly supporting the flexible wiring board at the coupling portion between the carriage and the tube supporting member and at the coupling portion between the main body of the printer and the tube supporting member, occurrence of offsetting of the flexible wiring board relative to the carriage and the main body of the printer, and breakage of the flexible wiring board can be prevented.

In addition, by making the depression force depressing the flexible wiring board smaller than the depression force depressing the flexible wiring board by the displacement restricting member or the roller in the vicinity of the coupling portion between the carriage and the tube supporting member and in the vicinity of the coupling portion between the main body of the printer and the tube supporting member, the flexible wiring board is movable with respect to the flexible wiring board supporting member with low load. In conjunction therewith, in the vicinity of the coupling portion between the carriage and the flexible wiring board and in the vicinity of the main body of the printer and the flexible wiring board, occurrence of offsetting of the flexible wiring board relative to the carriage and the main body of the printer resulting in breakage of the flexible wiring board, can be prevented.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus employing a head ejecting ink and performing printing by ejecting the ink on a printing medium from said head, comprising:

a main body;

head mounting means for mounting said head, said head mounting means being reciprocally movable relative to said main body;

a flexible wiring board electrically connecting said head and an electric board installed in said main body and having a curved portion;

a displacement restriction member restricting displacement of the flexible wiring board associated with movement of the head mounting means, said displacement restriction member having a construction with a small sliding resistance with said flexible wiring board, with respect to a first portion contacting said flexible wiring board; and tube supporting means for supporting a tube supplying an ink from an ink tank installed on said main body to said head and having a curved portion, said tube supporting means having a construction with a small sliding resistance with the tube, with respect to at least a second portion contacting the tube.

2. An ink-jet printing apparatus as claimed in claim 1, wherein said tube supporting means is constructed with a caterpillar of a polyarticular link structure connected to said main body at one end and to said head mounting means at the other end thereof, and a plurality of said displacement restricting members are held by said caterpillar in a curve direction of said caterpillar.

3. An ink-jet printing apparatus as claimed in claim 1, wherein a radius of said curved portion of said flexible wiring board is smaller than a radius of the curve portion of the tube.

4. An ink-jet printing apparatus as claimed in claims 1, wherein said flexible wiring board is fixedly supported at a coupling portion between said head mounting means and said tube supporting means and/or at a coupling portion between said main body and said tube supporting means.

5. An ink-jet printing apparatus as claimed in claim 4, further comprising a depressing member depressing said flexible wiring board to said displacement restricting member, wherein a depressing force by said depressing member is smaller than a supporting force in the vicinity of the coupling portion between said head mounting means and said tube supporting means and in the vicinity of the coupling portion between said main body and said tube supporting means.

6. An ink-jet printing apparatus as claimed in any one of claims 1 to 5, wherein said head generates a bubble in the ink using a thermal energy and ejects the ink by a pressure of the bubble.

7. An ink-jet printing apparatus as claimed in claim 1, wherein the construction, in which the sliding resistance is made small, is formed with a material having high slidability for the first and second contacting portions.

8. An ink-jet printing apparatus as claimed in claim 7, wherein the material for the first contacting portion and the material for the second contacting portion are different from each other.

9. An ink-jet printing apparatus as claimed in claim 7, wherein the material having high slidability is fluorine resin, polyacetal, polyethylene or nylon.

10. An ink-jet printing apparatus employing a head ejecting ink and performing printing by ejecting the ink on a printing medium from said head, comprising:

a main body;

head mounting means for mounting said head, said head mounting means being reciprocally movable relative to said main body;

a tube supplying the ink from an ink tank installed on said main body to said head and having a first curved portion;

a flexible wiring board electrically connecting said head and an electric board installed in said main body, and having a second curved portion, said flexible wiring board being located inside the first curved portion of the tube at the second curved portion thereof;

a displacement restriction member restricting displacement of the flexible wiring board associated with movement of the head mounting means, said displacement restriction member having a construction with a small sliding resistance with said flexible wiring board, with respect to a first portion contacting said flexible wiring board; and tube supporting means for supporting said tube, said tube supporting means having a construction with a small sliding resistance with said tube with respect to a second portion contacting said tube.

11. An ink-jet printing apparatus as claimed in claim 10, wherein said tube supporting means comprises a caterpillar of a polyarticular link structure connected to said main body at one end and to said head mounting means at another end thereof, and a plurality of the displacement restricting members are held by said caterpillar in a direction of a curve of the caterpillar.

12. An ink-jet printing apparatus as claimed in claim 10, wherein said flexible wiring board is fixedly supported at a coupling portion between said head mounting means and said tube supporting means and/or at a coupling portion between said main body and said tube supporting means.

13. An ink-jet printing apparatus as claimed in claim 12, further comprising a depressing member depressing said flexible wiring board to said displacement restricting member, and wherein a depressing force by said depressing member is smaller than a supporting force associated with the coupling portion between said head mounting means and said tube supporting means and/or a supporting force associated with the coupling portion between said main body and said tube supporting means.

14. An ink-jet printing apparatus as claimed in claim 10, wherein, in the construction in which sliding resistance is made small, a material having high slidability is used for said first and second contacting portions.

15. An ink-jet printing apparatus as claimed in claim 14, wherein the material for said first contacting portion and the material for the second contacting portion are different from each other.

16. An ink-jet printing apparatus as claimed in claim 14, wherein the material having high slidability is fluorine resin, polyacetal, polyethylene or nylon.

* * * * *

UNITED STATES PATENT AND TRADEMARK OFFICE

CERTIFICATE OF CORRECTION

PATENT NO. : 6,113,217

DATED : September 5, 2000

INVENTOR(S) : ARAKI ET AL.

It is certified that error appears in the above-identified patent and that said Letters Patent is hereby corrected as shown below:

COLUMN 1:
Line 31, "to" (second occurrence) should read --the--.

COLUMN 2:
Line 51, "a" should read --the--.
Line 66, "respective of" should be deleted.

COLUMN 6:
Line 26, "slide" should read --slid--.
Line 63, "man" should read --main--.

COLUMN 7:
Line 14, "to" (second occurrence) should be deleted.

COLUMN 8:
Line 2, "a not shown" should read --an unshown--.
Line 12, "becomes" should read --comes--.
Line 23, "reason, is" should read --reasons, are--.

COLUMN 10:
Line 21, "ondemand" should read --on-demand--.

UNITED STATES PATENT AND TRADEMARK OFFICE

CERTIFICATE OF CORRECTION

PATENT NO. : 6,113,217

DATED : September 5, 2000

INVENTOR(S) : ARAKI ET AL.

It is certified that error appears in the above-identified patent and that said Letters Patent is hereby corrected as shown below:

COLUMN 12:
Line 65, "the" should read --said--.
Line 66, "the" should read --said--.

COLUMN 13:
Line 21, "claims 1," should read --claim 1,--.

COLUMN 14:
Line 11, "the" should read --said--.
Line 12, "the" should read --said--.
Line 26, "the" should read --said--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*